US005694980A

United States Patent [19]

Quigley

[11] Patent Number: 5,694,980

[45] Date of Patent: Dec. 9, 1997

[54] WOVEN FABRIC

[75] Inventor: Scott Quigley, Townville, S.C.

[73] Assignee: Wangner Systems Corporation, Greenville, S.C.

[21] Appl. No.: 666,959

[22] Filed: Jun. 20, 1996

[51] Int. Cl.[6] ..... D03D 13/00

[52] U.S. Cl. ..... 139/383 A

[58] Field of Search ..... 139/383 A

[56] References Cited

U.S. PATENT DOCUMENTS

| | | | |
|---|---|---|---|
| 4,314,589 | 2/1982 | Buchanan et al. | 139/383 A |
| 4,739,803 | 4/1988 | Borel | 139/383 A |
| 4,985,084 | 1/1991 | Hakkarainen et al. | 139/383 A |
| 5,067,526 | 11/1991 | Herring | 139/383 A |
| 5,074,339 | 12/1991 | Vohringer | 139/383 A |
| 5,164,249 | 11/1992 | Tyler et al. | 139/383 A |
| 5,169,709 | 12/1992 | Fleischer | 139/383 A |
| 5,487,414 | 1/1996 | Kuji et al. | 139/383 A |
| 5,544,678 | 8/1996 | Barrett | 139/383 A |
| 5,555,917 | 9/1996 | Quigley | 139/383 A |

*Primary Examiner*—Andy Falik

*Attorney, Agent, or Firm*—Henry S. Jaudon; Cort Flint

[57] ABSTRACT

A thin dual layer papermaking fabric having an upper layer of weft yarns and a lower layer of weft yarns weaving with a single layer of warp yarns. The upper weft yarns and warp yarns form a paper fiber support surface while the lower weft yarns and the warp yarns form a machine contact surface. The support surface is comprised of a plurality of equal length weft yarn floats arranged in a zig-zag pattern along the length of the fabric and no warp yarn floats. This construction provides a smooth substantially monoplane support surface.

15 Claims, 3 Drawing Sheets

WOVEN FABRIC

BACKGROUND OF THE INVENTION

The present invention relates to papermaking fabrics for use with papermaking machines. The invention is specifically directed to a multilayer fabric made of synthetic filaments for use in the forming section of papermaking machines for support of paper forming fibers during the removal of water therefrom.

In the manufacture of paper products, the development over the years has led to ever-increasing production speeds to within range of 3000 to 7000 feet per minute. These high speeds place ever increasing stress on the papermaking fabric which tends to cause the yarns forming the fabric to shift which causes uneven markings on the paper. At the same time, the high speeds require that the drainage capability of the fabric keep pace. Finally, the fabrics must have a paper fiber support surface capable of increased support capability.

There have been steps toward achieving these goals as illustrated in U.S. Pat. Nos. 4,985,084; 4,739,803; and 4,314,589.

U.S. Pat. No. 5,555,917 to S. Quigley and assigned to Wangner Systems, the inventor and assignee of the instant application, is directed to a dual layer papermaking fabric for use in the dryer section. The fabric is formed with a support surface having a weave pattern and weave density different from that of the machine surface. The weave pattern for the support surface produces variable length weft floats while the machine surface weave produces weft floats of equal length. The weave of the instant invention provides a dual layer papermaking fabric for use in the dryer section in which the weave pattern for the support surface produces weft floats of equal length arranged in a uniform pattern while the machine surface weave pattern provides also weft floats of equal length arranged in a uniform pattern. The weave patterns between the surfaces differ and the density of the support surface is greater than that of the machine surface. Both weaves provide fabrics which are stable in both the machine and cross-machine direction and provide for uniform drainage.

Accordingly, an object of the present invention is to provide a forming fabric for papermaking which has the capability of having a high degree of paper fiber support.

Another object of the present invention is to provide a thin dual layer papermaking fabric.

Another object of the present invention is to provide a dual layer papermaking fabric having a caliper of no more than 0.6 mm.

Another object of the invention is to provide a papermaking fabric which has good seaming capability.

It is another object of the invention to provide a papermaking fabric which leaves a minimum of marks on the paper product.

SUMMARY OF THE INVENTION

The fabric of the invention is a woven dual layer papermaking fabric comprising warp and weft yarns forming an upper paper fiber support surface and a lower machine contacting or running surface. The fiber support surface consists of a plurality of equal length weft yarn floats in which the weft yarns pass over a plurality of warp yarns. These weft yarn floats are formed with the weft yarn extending over between five warp yarns and ten warp yarns with the preferred weft float extending over seven warp yarns. The support surface is formed with no warp floats.

The running surface comprises a plurality of equal length weft yarn floats in which a plurality of weft yarns pass beneath a plurality of warp yarns. Successive floats of the weft yarn floats forming the running surface are separated by at least three warp yarns. The running surface also includes a plurality of warp yarn floats in which a plurality of the warp yarns pass beneath a plurality of weft yarns.

The relationship of the warp and weft yarns forms a papermaking fabric in which the support surface provides a high degree of fiber support capability while the fabric provides an even drainage capability.

The weave pattern of the support surface produces a plurality of continuous zig-zag stripes or patterns along the length of the fabric.

The support surface is formed to have twice as many weft yarns as are provided to form the running surface. The weft yarns forming the fabric are preferably of equal size.

A thin dual layer papermaking fabric formed to have an upper layer of weft yarns and a lower layer of weft yarns weaving with a single layer of warp yarns. The number of weft yarns forming the upper layer is twice the number of weft yarns forming the lower layer. The upper weft yarns form with the warp yarns a paper fiber support surface while the lower weft yarns form with the warp yarns a machine contacting surface. The upper weft yarns are woven with the warp yarns to form a plurality of equal length weft yarn floats arranged in a zig-zag pattern along the length of the fabric. The warp yarns form sharp crimps or knuckles where they cross over the weft yarns on both the fiber support and the machine contacting surfaces.

The warp and weft yarns are synthetic monofilament yarns preferably formed of polyester. All yarns are preferably of equal size with the number of upper layer weft yarns being twice the number of the lower layer weft yarns. The weave produces a fabric in which the caliper is less than 0.6 mm.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
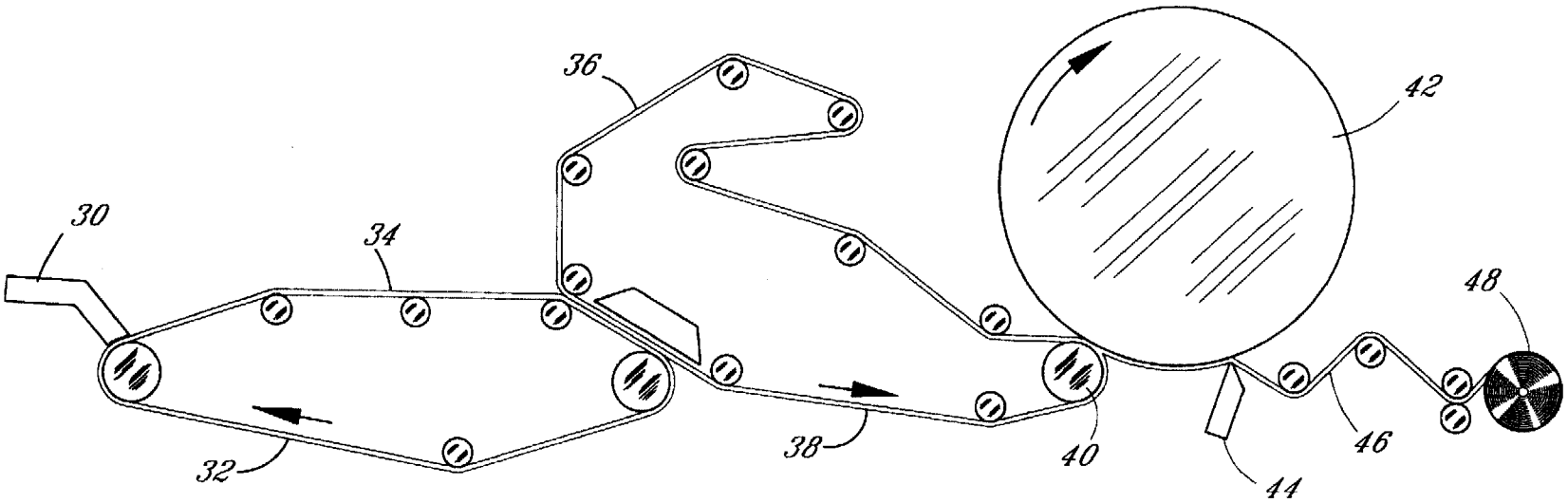
FIG. 1 is a diagrammatic view of a typical papermaking machine.

Referring now to the drawings, particularly FIG. 1, there is shown an illustration of a typical papermaking machine. The illustration depicts a head box 30 which deposits an aqueous slurry of papermaking fibers onto fiber support surface 34 of the continuous forming fabric 32. The paper forming fibers form a web on support surface 34 as the water is extracted through forming fabric 32 and removed by usual suction devices, not shown. As forming fabric 32 rotates in the direction of the arrow, the web of paper forming fibers are transferred to felt fabric 36. The web of paper fibers moves with lower surface 38 of felt 36 toward dryer 42. As the web is passed between pressure roll 40 and dryer 42, it is transferred to the dryer drum which dries the web forming paper. A doctor blade 44 removes paper 46 from dryer 42. Paper 46 is then wound onto roll 48 and readied for further processing.

In order to produce a paper product having a minimum of markings and a high degree of uniformity and good density, it is essential that the paper support surface of fabric 32 provides a high degree of paper fiber support capability. The weave which provides such a fabric is shown in FIGS. 2–5.

Figure 2:
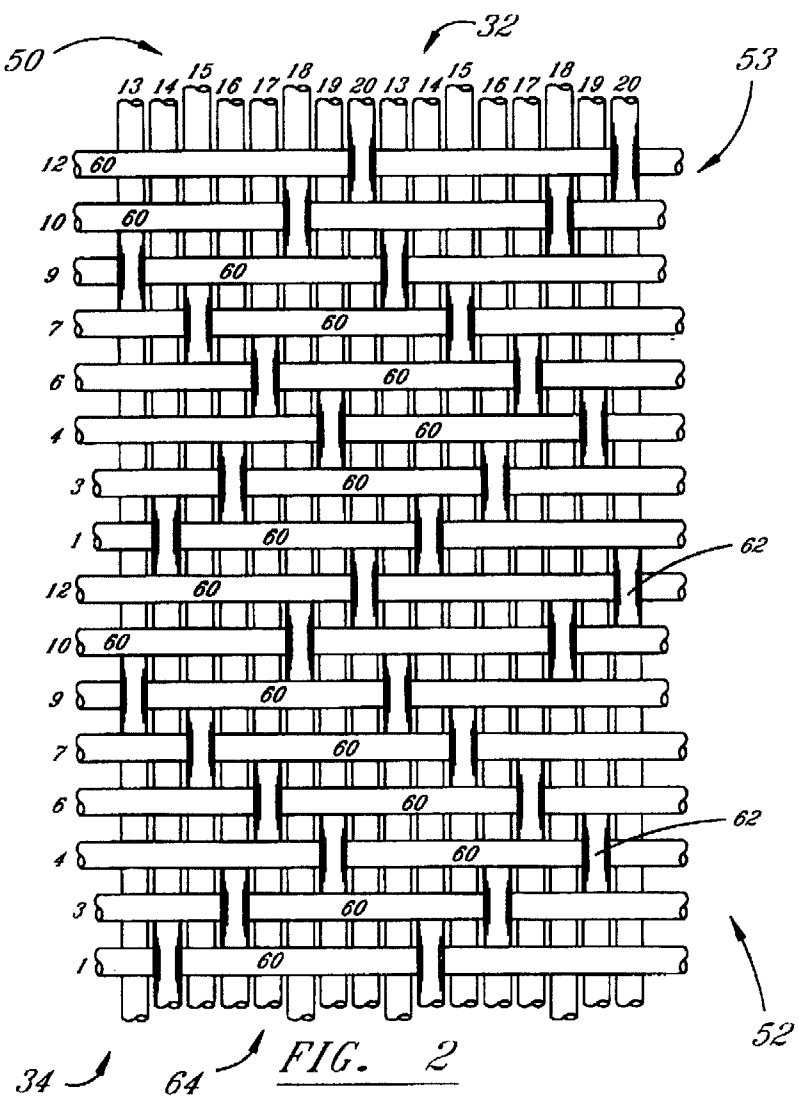
FIG. 2 is a top view of the fiber support surface of the fabric of the invention.
Figure 5:
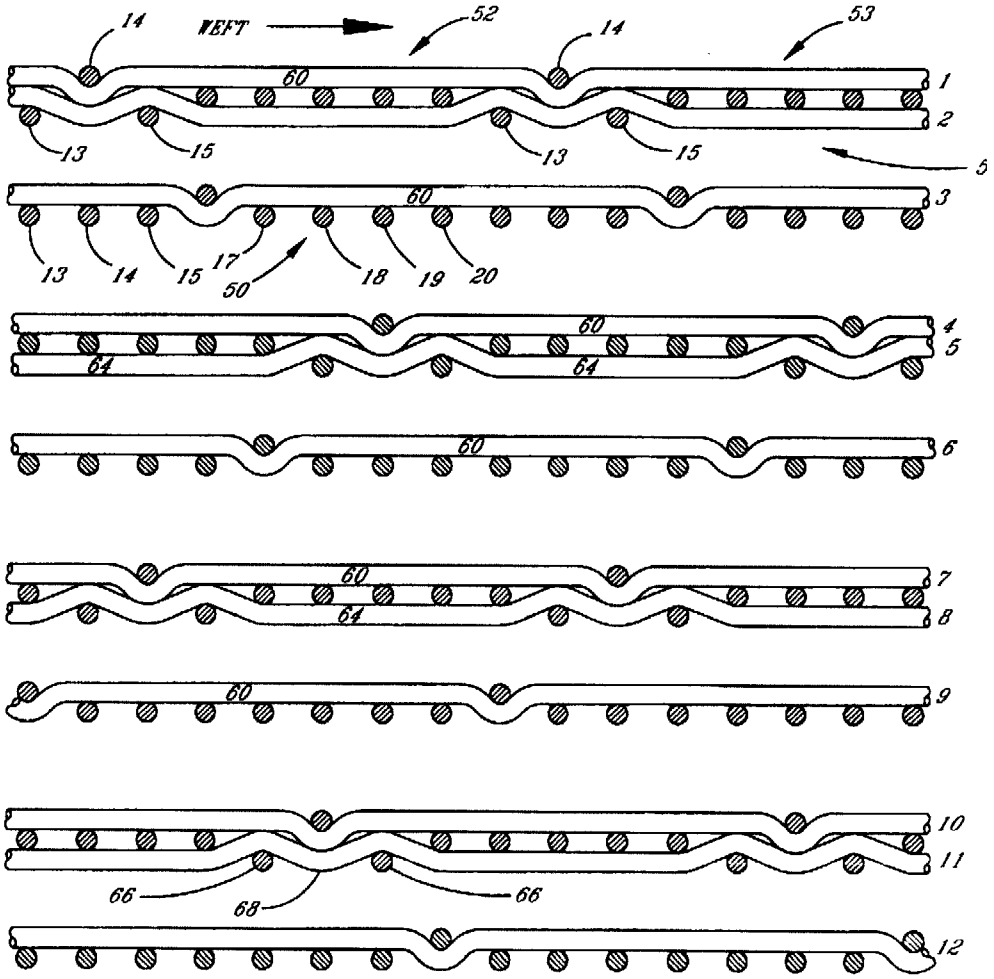
FIG. 5 is an end view of one repeat of the weave pattern showing the crosswise positions of the weft threads.
Figure 4:
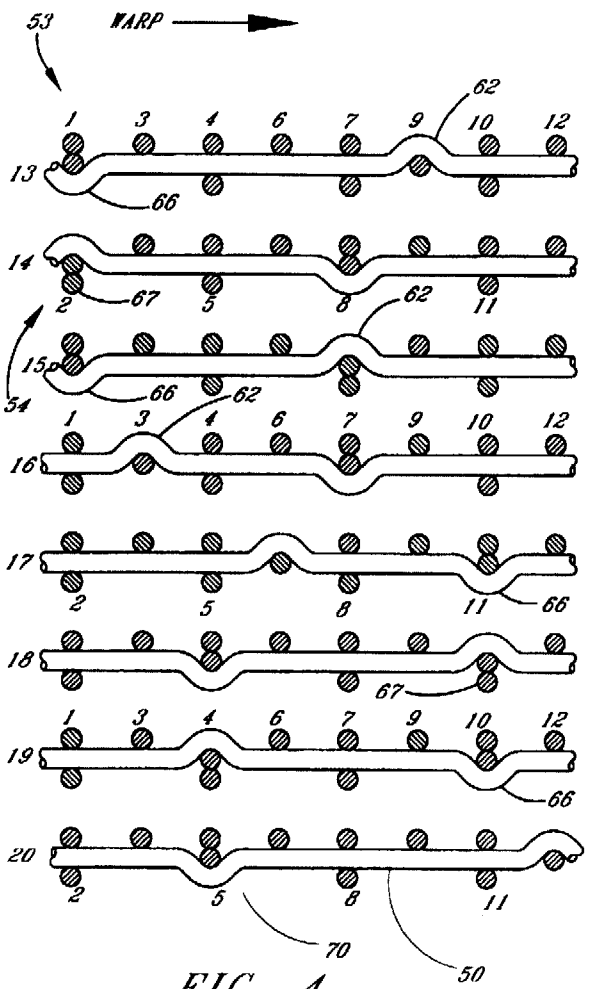
FIG. 4 is a side view of one repeat of the weave pattern showing the lengthwise position of the warp threads.

The weave structure shown is a double layer papermaking fabric 32 having a weave pattern consisting of twelve picks of weft yarn interwoven with eight warp yarns. Weft yarn 52 is interwoven with warp yarn 50 sequentially with picks 1–12. Picks 1, 3, 4, 6, 7, 9, 10 and 12 are woven into upper layer 52 forming support surface 34 as shown in FIGS. 2, 4, and 5 while picks 2, 5, 8, and 11 are woven into lower layer 54. Picks 1 and 2, 4 and 5, 7 and 8, 10 and 11 are woven in vertical alignment with pick 1, 4, 7, and 10 weaving in the upper layer and picks 2, 5, 8, and 11 weaving in the lower layer. Picks 3, 6, 9, and 12 weave between the referred to vertically aligned picks and weave only in the upper layer.

FIG. 2 shows the warp/weft relationship as appears on the support surface through two repeats of the weave pattern. It can be seen that only the weft yarns of picks 1, 3, 4, 9, 10 and 12 appear on this surface. These yarns are upper weft yarns 53 of weft yarns 52. As can be seen, each weft yarn forms an extended upper weft float 60 which passes over seven consecutive warp yarns 50 and then beneath a single warp yarn forming knuckles 62. The pattern is a broken twill which forms a series of side by side zig-zag or serpentine patterns 64 along the length of the fabric.

The weft yarn floats 60 create smooth, uncrimped surfaces over a major portion of the support surface 34. These along with the relatively high density on the weave on the support surface creates a flat surface capable of a high degree of fiber support and one which produces a minimum of markings on the paper surface.

Figure 3:
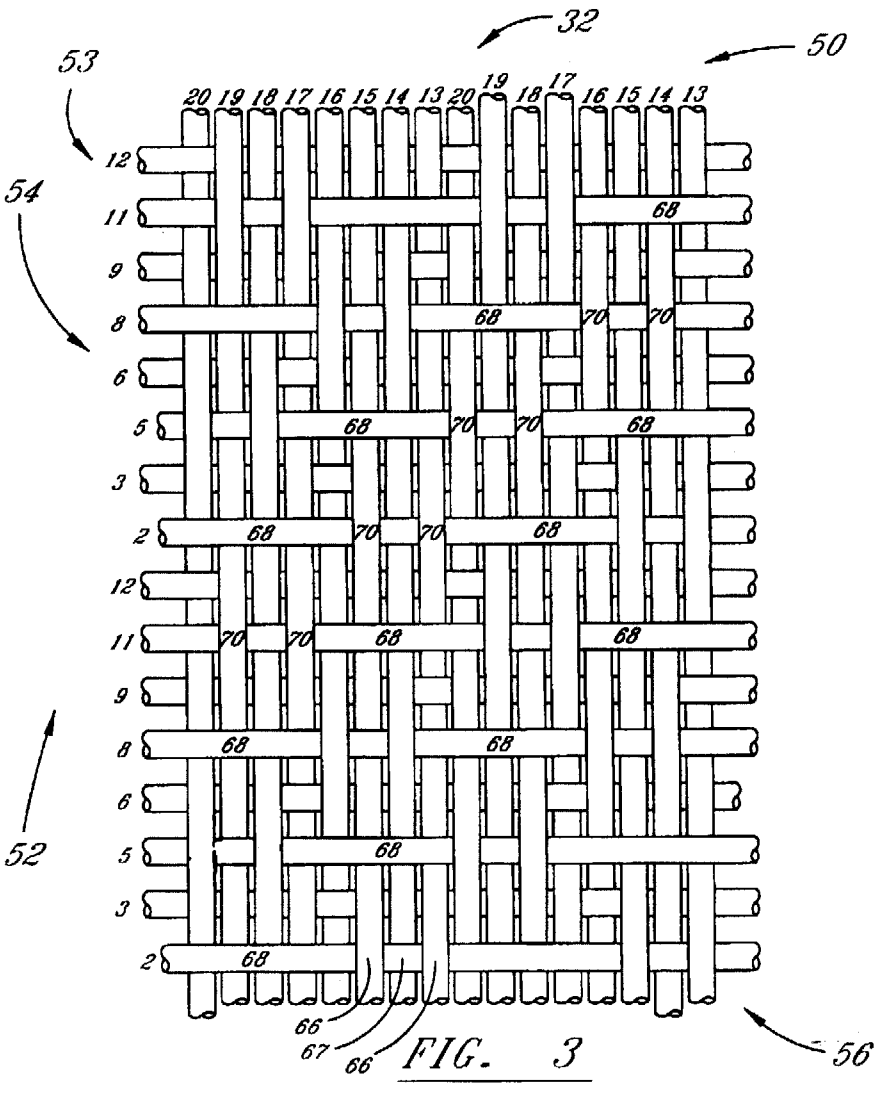
FIG. 3 is a bottom view of the running or machine contact surface of the fabric of the invention.

Turning now to FIG. 3. Here is shown the lower surface of papermaking fabric 34. This lower surface constitutes the machine contacting or running surface 56. The weave pattern or the interrelationship of lower weft yarns 54 with warp yarns 50 presents a surface which is substantially neutral, i.e. the warp and weft are substantially equally exposed.

Picks 2, 5, 8 and 11 of lower weft yarns 54 weave with warp yarns 50 to pass beneath five consecutive warp yarns forming lower weft floats 68 before being tied in by weaving under, over and under consecutive warp yarns 50 forming knuckles 66 and 67. Floats 68 are arranged in diagonal rows along the length of the fabric.

Warp yarns 50 on running surface 56 weave with weft yarns 52 to form paired spaced floats 70 each of which pass beneath three weft yarns. The pairs of warp floats 70 are also arranged along diagonal lines along the length of the fabric. The diagonal lines formed by weft floats 68 alternate with the diagonal lines formed by warp floats 70 across the width of the fabric.

Turning now to FIG. 4, where the relationship of each warp 13–20 of warp yarns 53 with each pick of weft yarn 52 for a repeat of Turning now to FIG. 4, where the relationship of each warp 13–20 of warp yarns 53 with each pick of weft yarn 52 for a repeat of the weave pattern is shown. Warp 13 weaves beneath each pick of upper weft yarns 53 except for pick 9 and above each pick of lower weft yarns 54 except for pick 2. Warp 14 weaves in a similar manner with weft yarns 53, 54 passing over only pick 1 of the upper layer of weft yarns and beneath only pick 8 of the lower layer of weft yarns. Warps 15–20 weave in a similar manner as clearly shown.

At each point where a warp yarn 50 passes over an upper weft yarn 53 or beneath a lower weft yarn 54 a well defined knuckle 62 and 66 is formed. These knuckles, which are permanently formed in the warp yarns, enable the formation of a strong seam when the fabric is made circular. Seaming of papermaking fabrics is well known and generally comprises reweaving opposed ends together. Because the knuckles are well spaced due to the number of floats appearing on both the fiber support surface and the machine contact surface the fabric as formed is a thin fabric. Using yarns of the size disclosed, the caliper, i.e. the distance between the support and contact surfaces never exceeds 6 mm and is normally in the range of 5 mm.

FIGS. 4 and 5 show the interrelationship of weft yarns 52 with warp yarns 50. It can be seen that picks 1, 4, 7, and 10 of upper weft yarns 53 weave in vertically aligned stacked relationship with lower weft yarns 54. These picks are separated by picks 3, 6, 9, and 12 of upper weft yarns 53 which weave in the spaces between The drawings show each of the warp and weft yarns as being one size which is the preferred arrangement. It is possible, however, to provide that the warp be of one size and the weft of another. Also, it is possible that the stacked weft yarns be of one size and the intermediate weft yarns of another. Another arrangement would have the lower layer weft yarns larger than the upper layer weft yarns.

It is preferred that the warp and weft yarns be monofilament synthetic yarns capable of operating at high temperatures and withstanding chemical degradation. Preferably, the monofilament yarns are formed of polyester, however, other synthetics such as nylon, PEEK, polyurethane, and polypropylene may also be suitable. The yarn diameter should range between 0.1 mm and 0.5 mm, and the fabric should have a porosity of between 300 and 800 CFM (cubic feet per minute). Alternatively, the warp and/or weft could be multifilament yarns.

While a preferred embodiment of the invention has been described using specific terms, such description is for illustrative purposes only, and it is to be understood that changes and variations may be made without departing from the spirit or scope of the following claims.

What is claimed is:

1. A dual layer papermaking fabric woven in a selected weave pattern and comprising warp yarns and a plurality of picks of weft yarn forming an upper paper fiber support surface and a lower machine running surface;

said fiber support surface comprising a plurality of equal length weft yarn floats in which picks of said weft yarn pass over a plurality of warp yarns and a plurality of warp yarn knuckles in which said warp yarns pass over single picks of said weft yarn;

said running surface comprises a plurality of equal length weft yarn floats in which a plurality of picks of weft yarn pass beneath a plurality of warp yarns and a plurality of warp yarn floats in which a plurality of said warp yarns pass beneath a plurality of picks of weft yarn; whereby, the relationship of said warp yarns and said picks of weft yarn produce a papermaking fabric of stable construction and a support surface having a high fiber support capability.

2. The fabric of claim 1 wherein said weave pattern of said support surface produces a plurality of continuous zig-zag patterns along the length of the fabric.

3. The fabric of claim 1 wherein said weft yarn floats formed on said support surface extend over at least five warp yarns.

4. The fabric of claim 3 wherein said weft yarn floats extend over seven warp yarns.

5. The fabric of claim 1 wherein there are twice as many picks of weft yarn forming the support surface as there are forming the running surface.

6. The fabric of claim 5 wherein said picks of weft yarn are of equal size.

7. The fabric of claim 1 wherein successive of said weft yarn floats forming said running surface are separated across the width of said fabric by at least three warp yarns.

8. A thin dual layer papermaking fabric having an upper layer of weft yarns and a lower layer of weft yarns weaving with a single layer of warp yarns, the number of said weft yarns forming said upper layer being twice the number of said weft yarns forming said lower layer;

said upper weft yarns and said warp yarns forming a paper fiber support surface and said lower weft yarns and said warp yarns forming a contact surface;

said upper weft yarns being woven with said warp yarns to form a plurality of equal length weft yarn floats which pass over equal numbers of said warp yarns, said weft yarn floats forming a zig-zag pattern along the length of said fabric;

said lower weft yarns being woven with said warp yarns to form a plurality of equal length weft yarn floats and a plurality of equal length warp yarn floats; whereby, said fabric is formed with a smooth substantially monoplane support surface with improved paper fiber support and drainage qualities.

9. The fabric of claim 8 wherein said warp and weft yarns are synthetic monofilament yarns.

10. The fabric of claim 9 wherein said synthetic forming said monofilament yarns is nylon.

11. The fabric of claim 8 wherein said warp yarns are of equal size.

12. The fabric of claim 8 wherein said weft yarns are of equal size.

13. The fabric of claim 8 wherein the caliper of said fabric is no more than 0.6 mm.

14. The fabric of claim 8 wherein said warp yarns form crossings with said weft yarns on both the support and contact surfaces, with said crossings being sharply crimped.

15. A thin dual layer papermaking fabric having a caliper of no more than 0.6 MM and having an upper layer of weft yarns and a lower layer of weft yarns weaving with a single layer of warp yarns, the number of said weft yarns forming said upper layer being twice the number of said weft yarns forming said lower layer;

said upper weft yarns and said warp yarns forming a paper fiber support surface and said lower weft yarns and said warp yarns forming a contact surface;

said upper weft yarns being woven with said warp yarns to form a plurality of equal length weft yarn floats which pass over equal numbers of said warp yarns, said weft yarn floats forming a zig-zag pattern along the length of said fabric; whereby, said fabric is formed with a smooth substantially monoplane support surface with improved paper fiber support and drainage qualities.

* * * * *